US005955831A

United States Patent [19]

Shibata et al.

[11] Patent Number: 5,955,831

[45] Date of Patent: Sep. 21, 1999

[54] CATHODE RAY TUBE WITH INSULATING TAPE BETWEEN SEAL AND CONDUCTIVE TAPE

[75] Inventors: Yoshiro Shibata, Kyoto; Misanobu Uozumi, Nevagawa, both of Japan

[73] Assignee: Matsushita Electric Industrial Co., Ltd., Osaka, Japan

[21] Appl. No.: 08/839,722

[22] Filed: Apr. 15, 1997

[30] Foreign Application Priority Data

Jul. 19, 1996 [JP] Japan ..... 8-190242

[51] Int. Cl.[6] ..... H01J 31/00

[52] U.S. Cl. ..... 313/479; 313/477 R; 313/480

[58] Field of Search ..... 313/477 R, 479, 313/480, 313; 220/2.1 R, 2.3 R, 2.37

[56] References Cited

FOREIGN PATENT DOCUMENTS 3-102746 4/1991 Japan .
06349409 12/1994 Japan .

*Primary Examiner*—Vip Patel
*Attorney, Agent, or Firm*—Ratner & Prestia

[57] ABSTRACT

A CRT assembly prevents high tension leakage from a seal. The CRT assembly includes a conductive tape for electrically connecting an outer conductive coating of a funnel part of the CRT and a tension band around a panel periphery. An insulating tape is inserted between the conductive tape and a seal of the CRT assembly so that the conductive tape is separated from the seal of the CRT assembly.

7 Claims, 2 Drawing Sheets

CATHODE RAY TUBE WITH INSULATING TAPE BETWEEN SEAL AND CONDUCTIVE TAPE

FIELD OF THE INVENTION

The present invention relates to a grounding assembly of an outer conductive coating painted on a funnel part of a cathode ray tube (CRT).

BACKGROUND OF THE INVENTION

An electrostatic capacitance is usually formed by glass of a funnel part of a CRT as dielectric material and inner and outer conductive coatings as electrodes. The panel part of the CRT is fastened tight by a metal band for safety, namely, against explosion of the glass bulb. When the CRT is used, both the metal band and the outer conductive coating should be grounded.

The outer conductive coating made of graphite is usually grounded by contacting a braided wire wound around the outer conductive coating with tension and grounding the braided wire.

The grounding braided wire is desirably long in the prior art. It is line contacted to the outer conductive coating with tension. A spring is desirable to pull the grounding braided wire with tension. This method is inferior in cost. Further, although the long grounding braided wire is easy to intertwine, it largely prevents automatic manufacturing in attaching it to the CRT.

To improve the above problem, a construction where the tension band (metal band) and the outer conductive coating are connected by an adhesive conductive tape is disclosed in Japanese Patent Laid-Open 3-102746.

In this case, the adhesive is unreliable over a long period. As for a CRT, the funnel part and the panel part are jointed by a seal and there is a danger of high tension leakage because the conductive tape directly touches the seal.

SUMMARY OF THE INVENTION

The outer conductive coating of the funnel part of a CRT and the tension band for reinforcement around the panel periphery of the CRT are electrically connected by a conductive tape and an insulating tape is put between the conductive tape touching to the seal and the outer surface of the CRT. Thus, a CRT which is not prone to high tension leakage at a seal of the CRT assembly can be presented.

Alternately, the outer conductive coating of the funnel part and the tension band for reinforcement fastened tight around a panel periphery are electrically connected by a conductive tape and a first insulating tape is put between the conductive tape touching the seal and the outer surface of the CRT and further a second insulating tape is glued on the conductive tape. Thus, a CRT which is not prone to high tension leakage at a seal of a CRT assembly can be presented.

BRIEF DESCRIPTION OF THE DRAWINGS

FIG. 4(*b*) is a cross sectional view of the assembly shown in FIG. 4(*a*) attached on a CRT.

DETAILED DESCRIPTION OF THE INVENTION

CRTs in accordance with two exemplary embodiments of the present invention are explained below, referring to FIGS. 1 to 4.

(First exemplary embodiment)

Figure 1:
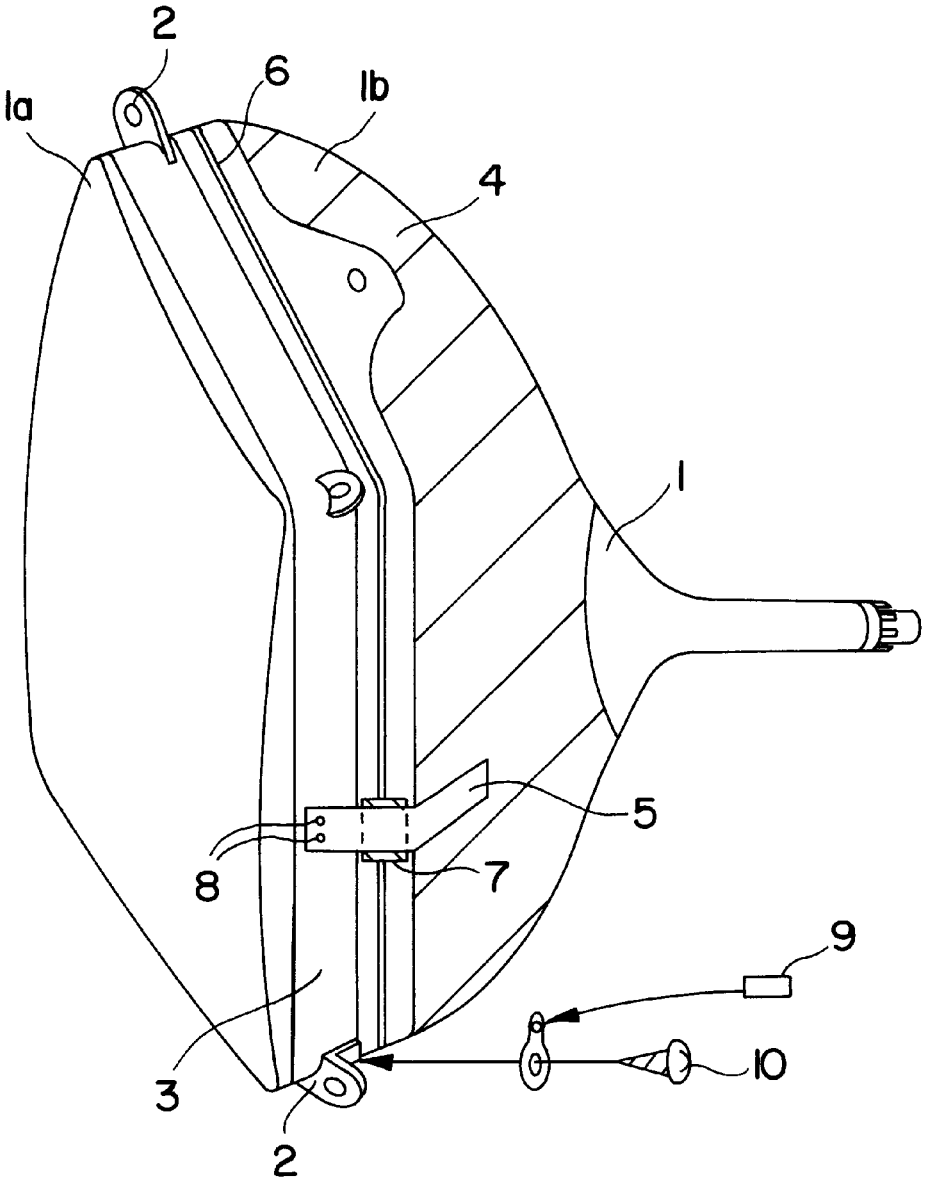
FIG. 1 is a perspective view of a CRT assembly in accordance with a first exemplary embodiment of the present invention.
Figure 2:
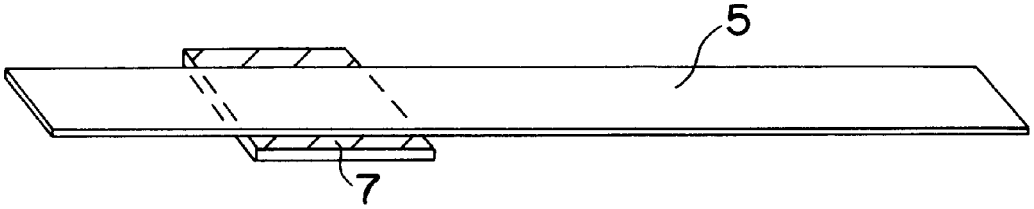
FIG. 2 is a perspective view of an assembly of a conductive tape and an insulation tape to be attached to the CRT in accordance with a first exemplary embodiment of the present invention.

FIG. 1 is a perspective view of a CRT assembly in accordance with a first exemplary embodiment of the present invention. FIG. 2 is a perspective view of an assembly of a conductive tape and an insulation tape to be attached to the CRT shown in FIG. 1.

In FIGS. 1 and 2, a bulb 1 of the CRT is fastened tight to a panel part 1*a* by a tension band (metal band) 3. Four holes 2 are provided in the projections extending from and located at the four corners of the tension band 3 to connect to an enclosure and the like. These projections are referred to as ear parts. An outer conductive coating 4 is painted on the outer surface of the funnel part 1*b*. Panel part 1*a* is jointed to funnel part 1*b* by a seal 6.

In such a usual CRT, tension band 3 and outer conductive coating are electrically connected by conductive tape 5 and an insulating tape 7 with a high insulation put between conductive tape 5 and seal 6 to prevent high tension leakage. Insulating tape 7 may be inserted between conductive tape 5 and seal 6 or insulating tape 7 may be wider than conductive tape 5 and may be previously adhered to the part of conductive tape 5 which would touch seal 6, shown in FIG. 2. Because of attaching conductive tape 5 and insulating tape 7, automation is easy. A spot welding 8 is added to the glued part on the tension band 3 to prevent dropping off of conductive tape 5.

A connecting wire 9 with a terminal is fastened to tension band 3 through the hole 2 in the ear part by a screw 10 as shown in FIG. 1 and tension band 3 is grounded by connecting wire 9.

Conductive tape 5 is made of conductive tape with conductive adhesive. Reliability is increased by pasting a plurality of conductive tapes 5.

(Second exemplary embodiment)

Figure 3:
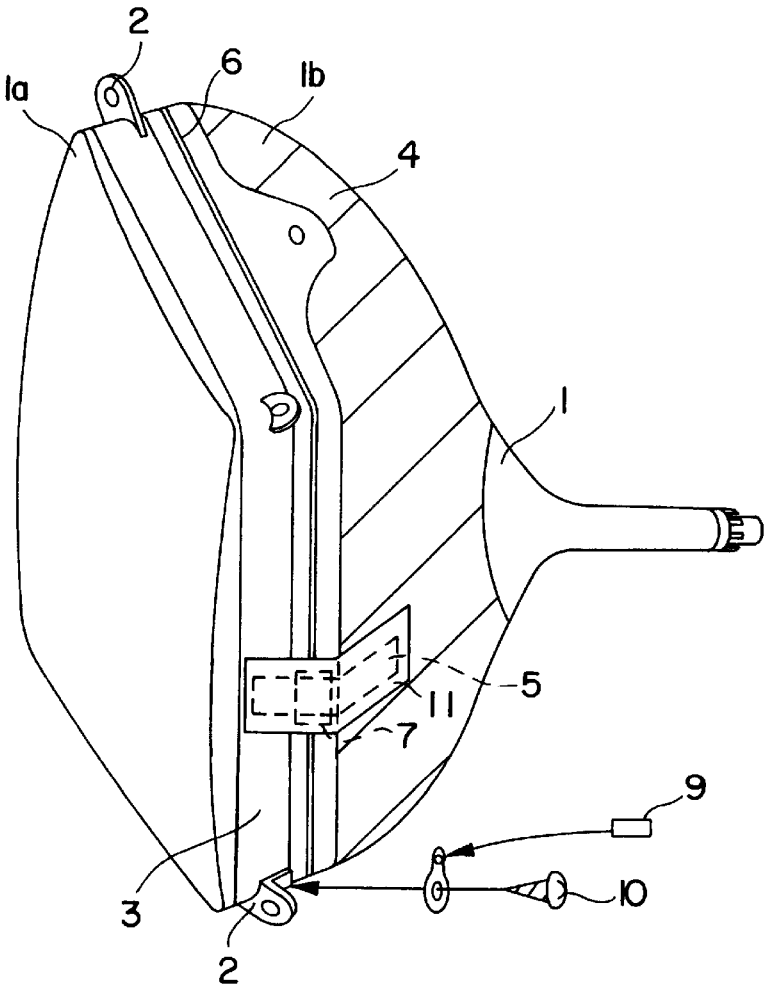
FIG. 3 is a perspective view of a CRT assembly in accordance with a second exemplary embodiment of the present invention.
Figure 4A:
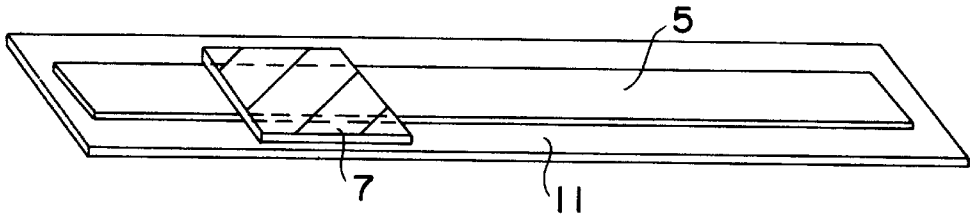
FIG. 4(*a*) is a perspective view of an assembly of a conductive tape and an insulation tape to be attached to the CRT in accordance with a second exemplary embodiment of the present invention.
Figure 4B:
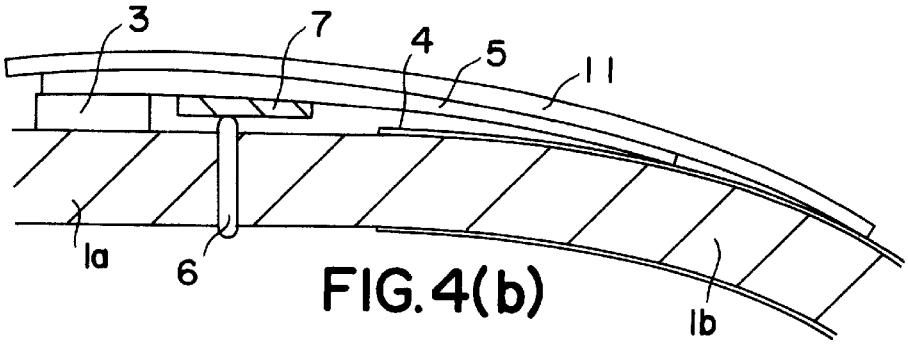

FIG. 3 is a perspective view of a CRT in accordance with a second exemplary embodiment of the present invention. FIG. 4(*a*) is a perspective view of an assembly of a conductive tape and an insulation tape to be attached to the CRT in accordance with a second exemplary embodiment of the present invention. FIG. 4(*b*) is a cross sectional view of the assembly shown in FIG. 4(*a*) attached on a CRT.

In this case, the construction is basically the same as that of the first exemplary embodiment, however, a second insulating tape is used in addition to the assembly of the first exemplary embodiment.

First insulating tape 7 is put between seal 6 and conductive tape 5 touching seal 6 second insulating tape 11 is adhered to conductive tape 5 and outer conductive coating 4 of funnel part 1*b* and tension band 3 for reinforcement around panel 1*a* are electrically connected by conductive tape 5. Second insulating tape 11 is larger than conductive tape 5 and covers it.

First insulating tape 7 can be a resin and second insulating tape 11 can be a resin tape with adhesive.

First insulating tape 7 and second insulating tape 11 can be adhesive resin tapes increasing the adhesive strength of conductive tape 5 to outer conductive coating 4.

First insulating tape 7 can be a resin tape with adhesive and second insulating tape 11 can be a glue painted resin tape.

First insulating tape 7 can be a resin tape without adhesive and second insulating tape 11 can be a glue painted resin tape.

For glue painted resin, for example, silicone resin, epoxy resin, acrylic resin, UV resin (ultra violet ray curing resin), buthyl rubber or the like can be used.

For the painting thickness, 5 to 50 microns may be used and about 25 microns is desirable.

In the first and second exemplary embodiments, the width, the length and the thickness of insulating tapes 7 and 11, and the painting area of the glue painted resin tapes can be arbitrarily selected.

Some concrete examples are introduced below.

(EXAMPLE 1)

For insulating tape 7 with insulation strength, insulating tape of 75 to 200 microns thick is desirable. Polyester tape of 125 microns was actually used.

For conductive tape 5, special acrylic adhesive dispersed with metallic particle is coated on a base of iron foil plated with nickel was used. The thickness is about 40 to 50 microns including adhesive layer and the contact resistance is about 0.007 ohm per 25 square millimeters. A conductive iron foil tape FE-20CX of Sumitomo 3M company is sold in the market.

The test result was as follows:

Heat cycle test (−40 to +80 degrees centigrade): no abnormality on insulation strength for continuous 8,000 hours.

Constant temperature and constant humidity test (+80 degrees centigrade temperature, 85% humidity): no abnormality on insulation strength for continuous 8,000 hours.

(EXAMPLE 2)

For insulating tape 7 with insulation strength, insulating tape of 25 to 150 microns thick is desirable. Polyester tape of about 75 microns thick coated with pressure sensitive adhesive of about 40 microns thick was actually used. An insulating tape, 1350 of Sumitomo 3M company, is sold in the market.

For conductive tape 5, special acrylic adhesive dispersed with metallic particle is coated on a base of iron foil plated with nickel was used. The thickness is about 40 to 50 microns including adhesive layer and the contact resistance is about 0.007 ohm per 25 square millimeters. A conductive iron foil tape FE-20CX of Sumitomo 3M company is sold in the market.

The test result was as follows:

Heat cycle test (−40 to +80 degrees centigrade): no abnormality on insulation strength for continuous 8,000 hours.

Constant temperature and constant humidity test (+80 degrees centigrade temperature, 85% humidity): no abnormality on insulation strength for continuous 8,000 hours.

(EXAMPLE 3)

Insulating tape 1350 of Sumitomo 3M company as first insulating tape 7, conductive iron foil tape FE-20CX of Sumitomo 3M company as conductive tape 5 and insulating tape 1350 of Sumitomo 3M company as second insulating tape 11 were used.

The test result was as follows:

Heat cycle test (−40 to +80 degrees centigrade): no abnormality on insulation strength for continuous 8,000 hours.

Constant temperature and constant humidity test (+80 degrees centigrade temperature, 85% humidity): no abnormality on insulation strength for continuous 8,000 hours.

Salt water spray test: no abnormality on insulation strength for continuous 72 hours.

As explained above, according to a CRT of the present invention, electrical insulation is made by putting an insulating tape on the seal and electrical connection is made by connecting the tension band and the outer conductive coating on the funnel part of the CRT by a conductive tape and thus the bulb surface potential can be kept to a ground potential and a danger of high potential leakage from the seal can be prevented. Further, grounding wires and springs used in the prior art are not required and either embodiment of the invention brings cost down and provides for easy automation of assembling.

The invention may be embodied in other specific form without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed:

1. A cathode ray tube assembly comprising:

a funnel part having an outer conductive coating;

a panel part having a panel periphery;

a seal between said panel part and said funnel part;

a tension band fastened around said panel periphery;

a conductive tape for electrically connecting said outer conductive coating of said funnel part of said cathode ray tube to said tension band; and an insulating tape inserted between said conductive tape and said seal so that said conductive tape is separated from said seal.

2. A cathode ray tube assembly as recited in claim 1, wherein said insulating tape is a resin tape.

3. A cathode ray tube assembly as recited in claim 2, wherein said resin tape includes adhesive.

4. A cathode ray tube assembly as recited in claim 2, wherein said conductive tape is connected to said tension band by spot welding.

5. A cathode ray tube assembly comprising:

a funnel part having an outer conductive coating;

a panel part having a panel periphery;

a seal between said panel part and said funnel part;

a tension band fastened around said panel periphery;

a conductive tape for electrically connecting said outer conductive coating of said funnel part of said cathode ray tube to said tension band; and a first insulating tape inserted between said conductive tape and said seal so that said conductive tape is separated from said seal; and a second insulating tape adhered to said conductive tape.

6. A cathode ray tube assembly as recited in claim 5, wherein said first insulating tape is a resin tape and said second insulating tape is an adhesive resin tape.

7. A cathode ray tube assembly as recited in claim 5, wherein said first insulating tape is a resin tape and said second insulating tape is a glue painted resin tape.

* * * * *